US009570012B2

(12) United States Patent
Lee et al.

(10) Patent No.: US 9,570,012 B2
(45) Date of Patent: Feb. 14, 2017

(54) DATA COMPENSATOR AND DISPLAY DEVICE INCLUDING THE SAME

(71) Applicant: SAMSUNG DISPLAY CO., LTD., Yongin, Gyeonggi-Do (KR)

(72) Inventors: Min-Woo Lee, Osan-si (KR); Seong-Kyun Kim, Seoul (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 14 days.

(21) Appl. No.: 14/799,830

(22) Filed: Jul. 15, 2015

(65) Prior Publication Data

US 2016/0225319 A1 Aug. 4, 2016

(30) Foreign Application Priority Data

Jan. 29, 2015 (KR) ..... 10-2015-0014079

(51) Int. Cl.
*G09G 3/32* (2016.01)
*G09G 3/20* (2006.01)

(52) U.S. Cl.
CPC ..... *G09G 3/3275* (2013.01); *G09G 3/20* (2013.01); *G09G 3/3208* (2013.01);
(Continued)

(58) Field of Classification Search
CPC ..... G09G 3/3275; G09G 2310/08; G09G 2320/0257; G09G 2320/0276; G09G 2320/0673; G09G 3/20; G09G 2360/16; G09G 3/3208; G09G 2320/0271; G09G 2320/046; G09G 3/32
See application file for complete search history.

(56) References Cited

U.S. PATENT DOCUMENTS

2007/0236431 A1 10/2007 Tada et al.
2010/0026731 A1* 2/2010 Konuma ..... G09G 5/04 345/690

(Continued)

FOREIGN PATENT DOCUMENTS

KR 10-2011-0078716 A 7/2011
KR 10-2012-0094736 A 8/2012

(Continued)

OTHER PUBLICATIONS

European Search Report dated Jun. 8, 2016 in Corresponding European Patent Application No. 15187607.5.

*Primary Examiner* — Md Saiful A Siddiqui
(74) *Attorney, Agent, or Firm* — Lee & Morse, P.C.

(57) ABSTRACT

A data compensator includes first logic, second logic, third logic, fourth logic, and fifth logic. The first logic calculates block compensation coefficients for blocks in a first frame based on first pixel data of the first frame. The second logic generates first gamma applied pixel data based on the first pixel data of the first frame and to generate second gamma applied pixel data based on the first gamma applied pixel data and second pixel data of a second frame adjacent the first frame. The third logic selects a number of the block compensation coefficients based on a pixel coordinate. The fourth logic generates a pixel compensation coefficient corresponding to the second pixel data by interpolating the selected block compensation coefficients based on the pixel coordinate. The fifth logic generates output pixel data based on the second gamma applied pixel data and the pixel compensation coefficient.

20 Claims, 10 Drawing Sheets

(52) U.S. Cl.
CPC . *G09G 2310/08* (2013.01); *G09G 2320/0257* (2013.01); *G09G 2320/0271* (2013.01); *G09G 2320/0276* (2013.01); *G09G 2320/046* (2013.01); *G09G 2320/0673* (2013.01); *G09G 2360/16* (2013.01)

(56) References Cited

U.S. PATENT DOCUMENTS

| | | | | |
|---|---|---|---|---|
| 2010/0053137 | A1 | 3/2010 | Park et al. | |
| 2011/0050751 | A1* | 3/2011 | Park | G09G 3/3208 345/690 |
| 2011/0148910 | A1* | 6/2011 | Botzas | G09G 5/02 345/600 |
| 2012/0154462 | A1* | 6/2012 | Hempson | G09G 3/342 345/691 |
| 2013/0147693 | A1 | 6/2013 | Bae | |
| 2014/0285533 | A1 | 9/2014 | Chun et al. | |

FOREIGN PATENT DOCUMENTS

| | | | |
|---|---|---|---|
| KR | 10-2013-0064552 | A | 6/2013 |
| KR | 10-2014-0075061 | A | 6/2014 |

* cited by examiner

FIG. 3

200

| | | |
|---|---|---|
| B1 | B2 | SBS<br>B3 |
| B4 | B5 | B6 |
| B7 | B8 | B9 |

FIG. 4

| | | |
|---|---|---|
| BSF1=0.8<br>B1 | BSF2=0.8<br>B2 | BSF3=1.4<br>B3 |
| BSF4=0.8<br>B4 | BSF5=0.8<br>B5 | BSF6=0.8<br>B6 |
| BSF7=0.8<br>B7 | BSF8=0.8<br>B8 | BSF9=0.8<br>B9 |

COMPARATIVE EXAMPLE

| | | |
|---|---|---|
| GBD1=200 B1 | GBD2=200 B2 | GBD3=200 B3 |
| GBD4=200 B4 | GBD5=200 B5 | GBD6=200 B6 |
| GBD7=200 B7 | GBD8=200 B8 | GBD9=200 B9 |

| | | |
|---|---|---|
| GSFD1=160 B1 | GSFD2=160 B2 | GSFD3=280 B3 |
| GSFD4=160 B4 | GSFD5=160 B5 | GSFD6=160 B6 |
| GSFD7=160 B7 | GSFD8=160 B8 | GSFD9=160 B9 |

DATA COMPENSATOR AND DISPLAY DEVICE INCLUDING THE SAME

CROSS-REFERENCE TO RELATED APPLICATION

Korean Patent Applications No. 10-2015-0014079, filed on Jan. 29, 2015, and entitled, "Data Compensator and Display Device Including the Same," is incorporated by reference herein in its entirety.

BACKGROUND

1. Field

One or more embodiments described herein relate to a data compensator and a display device including a data compensator.

2. Description of the Related Art

An organic light emitting display generates images using organic light emitting diodes. Because these diodes are self-emissive, a backlight unit is not used as is typically found in a liquid crystal display. An organic light emitting display offers many advantages over other types of flat panel displays. For example, organic light emitting displays are relatively thin and light and have low power consumption, improved luminance, and improved response speed compared to liquid crystal displays. As a result, organic light emitting displays are often used in portable electronic devices.

Some television channels broadcast information that is to be continuously displayed on a screen. Examples include network or channel logos (e.g. NBC, CBS). These logos are displayed with the same pattern, with high luminance, and at a same location on a screen. Consequently, the mobility of the driving transistors of pixels that display the logo may degrade over time. Once a pixel circuit degrades, image sticking may occur, e.g., the logo may be displayed on the screen for images which are not supposed to have the logo. As a result, display quality is degraded.

SUMMARY

In accordance with one or more embodiments, a data compensator includes a block compensation coefficient generator to calculate block compensation coefficients corresponding to blocks in a first frame based on first pixel data of the first frame; a gamma applier to generate first gamma applied pixel data by applying a first gamma curve corresponding to a first frame compensation margin to the first pixel data of the first frame, the gamma applier to generate second gamma applied pixel data by applying a second gamma curve corresponding to a second frame compensation margin to a second pixel data of a second frame, which is a next frame of the first frame; a compensation margin generator to generate the second frame compensation margin based on the block compensation coefficients and the first gamma applied pixel data; a block compensation coefficient storage to store the block compensation coefficients, to select some block compensation coefficients among the block compensation coefficients based on a pixel coordinate, to output the selected block compensation coefficients; a pixel compensation coefficient generator to generate a pixel compensation coefficient corresponding to the second pixel data by interpolating the selected block compensation coefficients based on the pixel coordinate; and a first multiplier to generate output pixel data by multiplying the second gamma applied pixel data and the pixel compensation coefficient.

The compensation margin generator may include a gamma applied block data generator to generate gamma applied block data corresponding to the blocks in the first frame based on the first gamma applied pixel data; a second multiplier to generate compensated gamma applied block data by multiplying the block compensation coefficients and the gamma applied block data, respectively; a maximum compensated gamma applied block data generator configured to output a largest value among the compensated gamma applied block data as a maximum compensated gamma applied block data; and a compensation margin calculator to calculate the second frame compensation margin based on the maximum compensated gamma applied block data. The compensation margin calculator may determine the second frame compensation margin based on a ratio of the maximum compensated gamma applied block data to a limit value of the gamma applied block data.

A first axis of the first gamma curve may correspond to each of the first pixel data and a second axis of the first gamma curve may correspond to each of the first gamma applied pixel data, and the first gamma curve may be generated by scaling a base gamma curve along the second axis based on the first frame compensation margin.

A first axis of the second gamma curve may corresponds to the second pixel data and a second axis of the second gamma curve may correspond to the second gamma applied pixel data, and the second gamma curve may be generated by scaling a base gamma curve along the second axis based on the second frame compensation margin.

The block compensation coefficient storage may output a first block compensation coefficient of a first block, a second block compensation coefficient of a second block, a third block compensation coefficient of a third block, and a fourth block compensation coefficient of a fourth block as the selected block compensation coefficients, the second block may be adjacent to the first block at a right side of the first block, the third block may be adjacent to the first block at a lower side of the first block, the fourth block may be adjacent to the second block at a lower side of the second block, and the fourth block is adjacent to the third block at a right side of the third block.

The pixel coordinate may correspond to the second pixel data. The block compensation coefficients may be inversely proportional to driving currents of the blocks, respectively. The driving current of a first block may be based on an average of driving currents of pixels in the first block. The block compensation coefficients may be inversely proportional to driving voltages of the blocks, respectively. The driving voltage of a first block may be based on an average of driving voltages of pixels in the first block. The block compensation coefficients may be proportional to degradation of pixels in the blocks. At least one of the block compensation coefficient generator, gamma applier, compensation margin generator, pixel compensation coefficient generator, and first multiplier may be implemented by instructions to be performed by a processor.

In accordance with one or more other embodiments, a display device includes a data compensator to generate an output pixel data; a timing controller to generate a data driver control signal and a scan driver control signal based on the output pixel data; a display panel including a plurality of pixels; a data driver to generate a plurality of data signals based the data driver control signal, the data driver to provide the data signals to the pixels through a plurality of data signal lines; and a scan driver to generate a plurality of scan signals based on the scan driver control signal, the scan driver to provide the scan signals to the pixels through a plurality of scan signal lines.

The data compensator includes a block compensation coefficient generator to calculate block compensation coefficients corresponding to blocks in a first frame based on first pixel data of the first frame; a gamma applier to generate first gamma applied pixel data by applying a first gamma curve corresponding to a first frame compensation margin to the first pixel data of the first frame, the gamma applier to generate second gamma applied pixel data by applying a second gamma curve corresponding to a second frame compensation margin to a second pixel data of a second frame, which is a next frame of the first frame; a compensation margin generator to generate the second frame compensation margin based on the block compensation coefficients and the first gamma applied pixel data; a block compensation coefficient storage to store the block compensation coefficients, to select some of the block compensation coefficients based on a pixel coordinate, to output the selected block compensation coefficients; a pixel compensation coefficient generator to generate a pixel compensation coefficient corresponding to the second pixel data by interpolating the selected block compensation coefficients based on the pixel coordinate; and a first multiplier to generate the output pixel data by multiplying the second gamma applied pixel data and the pixel compensation coefficient.

The compensation margin generator may include a gamma applied block data generator to generate gamma applied block data corresponding to the blocks in the first frame based on the first gamma applied pixel data; a second multiplier to generate compensated gamma applied block data by multiplying the block compensation coefficients and the gamma applied block data, respectively; a maximum compensated gamma applied block data generator to output the biggest value among the compensated gamma applied block data as a maximum compensated gamma applied block data; and a compensation margin calculator to calculate the second frame compensation margin based on the maximum compensated gamma applied block data. The compensation margin calculator may determine the second frame compensation margin based on a ratio of the maximum compensated gamma applied block data to a limit value of the gamma applied block data.

In accordance with one or more other embodiments, a compensator includes first logic to calculate block compensation coefficients for blocks in a first frame based on first pixel data of the first frame; second logic to generate first gamma applied pixel data based on the first pixel data of the first frame and to generate second gamma applied pixel data based on the first gamma applied pixel data and second pixel data of a second frame adjacent the first frame; third logic to select a number of the block compensation coefficients based on a pixel coordinate; fourth logic to generate a pixel compensation coefficient corresponding to the second pixel data by interpolating the selected block compensation coefficients based on the pixel coordinate; and fifth logic to generate output pixel data based on the second gamma applied pixel data and the pixel compensation coefficient.

The second logic may generate the first gamma applied pixel data by applying a first gamma curve corresponding to a first frame compensation margin to the first pixel data of the first frame, and generate the second gamma applied pixel data by applying a second gamma curve corresponding to a second frame compensation margin to the second pixel data of the second frame. The compensator may include sixth logic to generate the second frame compensation margin based on the block compensation coefficients and the first gamma applied pixel data. At least one of the first through fifth logic may be implemented by instructions for controlling a computer.

BRIEF DESCRIPTION OF THE DRAWINGS

Features will become apparent to those of skill in the art by describing in detail exemplary embodiments with reference to the attached drawings in which:

FIG. 3 illustrates an example of a first frame including a plurality of blocks;

FIG. 4 illustrates an example of compensation coefficients for the blocks;

DETAILED DESCRIPTION

Figure 1:
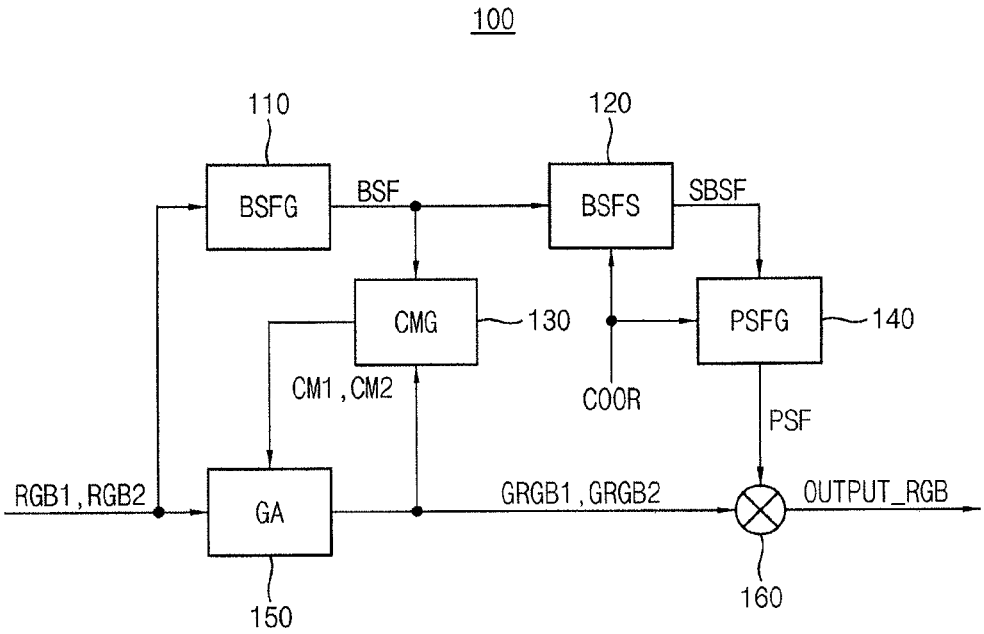
FIG. 1 illustrates an embodiment of a data compensator.

Example embodiments are described hereinafter with reference to the drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments. Like reference numerals refer to like elements throughout.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

FIG. 1 illustrates an embodiment of a data compensator 100 which includes a block compensation coefficient generator BSFG 110, a gamma applier GA 150, a compensation margin generator CMG 130, a block compensation coefficient storage BSFS 120, a pixel compensation coefficient generator PSFG 140, and a first multiplier 160. The block compensation coefficient generator 110 calculates block compensation coefficients BSF corresponding to blocks in a first frame based on first pixel data RGB1 of the first frame.

The gamma applier 150 generates first gamma applied pixel data GRGB1, by applying a first gamma curve corresponding to a first frame compensation margin CM1 to the first pixel data RGB1 of the first frame. The compensation margin generator 130 generates the second frame compensation margin CM2 based on the block compensation coefficients BSF and the first gamma applied pixel data GRGB1.

The gamma applier 150 generates second gamma applied pixel data GRGB2 by applying a second gamma curve corresponding to the second frame compensation margin CM2 to a second pixel data RGB2 of a second frame, which is next frame of the first frame.

The block compensation coefficient storage 120 stores the block compensation coefficients BSF, selects some block compensation coefficients SBSF among the block compensation coefficients BSF based on a pixel coordinate COOR, and outputs the selected some block compensation coefficients SBSF. The pixel compensation coefficient generator 140 generate a pixel compensation coefficient PSF corresponding to the second pixel data RGB2 by interpolating the selected some block compensation coefficients SBSF based on the pixel coordinate COOR. The first multiplier 160 generates an output pixel data OUTPUT_RGB by multiplying the second gamma applied pixel data GRGB2 and the pixel compensation coefficient PSF. The pixel coordinate COOR may be a coordinate of a pixel corresponding to the second pixel data RGB2.

Figure 2:
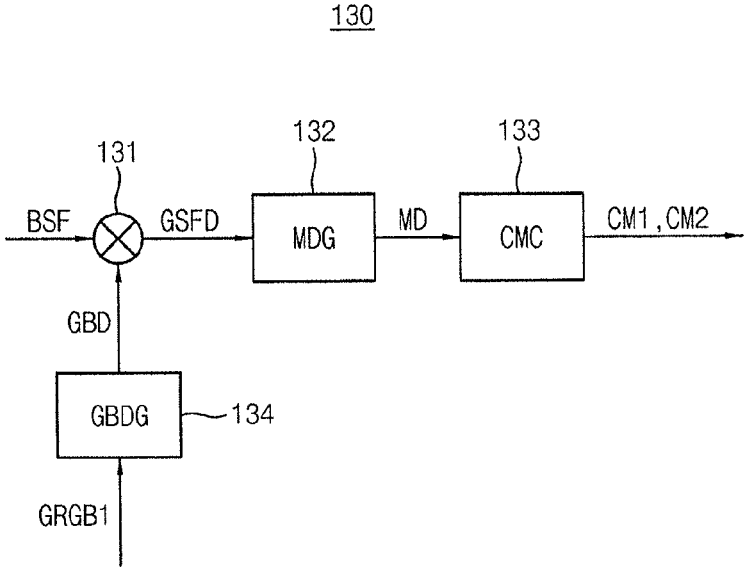
FIG. 2 illustrates an embodiment of a compensation margin generator.

FIG. 2 illustrates an embodiment of a compensation margin generator, which, for example, may be included in the data compensator 100 of FIG. 1. Referring to FIG. 2, the compensation margin generator 130 includes a gamma applied block data generator GBDG 134, a second multiplier 131, a maximum compensated gamma applied data generator MDG 132, and a compensation margin calculator CMC 133.

The gamma applied block data generator 134 generates gamma applied block data GBD corresponding to the blocks in the first frame based on the first gamma applied pixel data GRGB1. In an example embodiment, the gamma applied block data generator 134 may generate an average value of the first gamma applied pixel data GRGB1 corresponding to pixels in each of the blocks as the gamma applied block data GBD. In another example embodiment, the gamma applied block data generator 134 may generate a median value of the first gamma applied pixel data GRGB1 corresponding to pixels in each of the blocks as the gamma applied block data GBD.

The second multiplier 131 generates compensated gamma applied block data GSFD by multiplying the block compensation coefficients BSF and the gamma applied block data GBD. The maximum compensated gamma applied block data generator 132 may output the largest value among the compensated gamma applied block data GSFD as a maximum compensated gamma applied block data MD. The compensation margin calculator 133 may calculate the second frame compensation margin CM2 based on the maximum compensated gamma applied block data MD.

The compensation margin calculator 133 determines the second frame compensation margin CM2 based on a ratio of the maximum compensated gamma applied block data MD to a limit value of the gamma applied block data GBD. In an example embodiment, the second frame compensation margin CM2 may have a value of (the maximum compensated gamma applied block data (MD)/the limit value of the gamma applied block data (GBD))−1.

FIG. 3 illustrates an example of a first frame 200 including a plurality of blocks. Referring to FIG. 3, the first frame 200 includes 9 blocks B1 through B9. In another embodiment, the first frame 200 may include a different number of blocks. FIG. 3 illustrates that some pixel in the third block B3 are used to form a logo image (e.g. "SBS"), and thus are degraded.

FIG. 4 illustrating an example of block compensation coefficients corresponding to blocks in the first frame of FIG. 3. Referring to FIG. 4, the block compensation coefficient generator 110 outputs 0.8 as the first block compensation coefficient BSF1 corresponding to the first block B1 in the first frame 200. The block compensation coefficient generator 110 outputs 0.8 as the second block compensation coefficient BSF2 corresponding to the second block B2 in the first frame 200. The block compensation coefficient generator 110 outputs 1.4 as the third block compensation coefficient BSF3 corresponding to the third block B3 in the first frame 200. The block compensation coefficient generator 110 outputs 0.8 as the fourth block compensation coefficient BSF4 corresponding to the fourth block B4 in the first frame 200. The block compensation coefficient generator 110 outputs 0.8 as the fifth block compensation coefficient BSF5 corresponding to the fifth block B5 in the first frame 200. The block compensation coefficient generator 110 outputs 0.8 as the sixth block compensation coefficient BSF6 corresponding to the sixth block B6 in the first frame 200. The block compensation coefficient generator 110 outputs 0.8 as the seventh block compensation coefficient BSF7 corresponding to the seventh block B7 in the first frame 200. The block compensation coefficient generator 110 outputs 0.8 as the eighth block compensation coefficient BSF8 corresponding to the eighth block B8 in the first frame 200. The block compensation coefficient generator 110 outputs 0.8 as the ninth block compensation coefficient BSF9 corresponding to the ninth block B9 in the first frame 200.

In an example embodiment, the block compensation coefficients BSF1 through BSF9 may be inversely proportional to driving currents of the blocks B1 through B9, respectively. Driving current of a first block B1 may be an average of driving currents of pixels in the first block B1. Driving current of a second block B2 may be an average of driving currents of pixels in the second block B2. Driving current of a third block B3 may be an average of driving currents of pixels in the third block B3. The driving current of the remaining blocks B4 through B9 may be similarly determined.

FIG. 4 may be understood as a case where the third block compensation coefficient BSF3 is larger than other block compensation coefficients BSF1, BSF2, BSF4 through BSF9 because the driving current of the third block B3 is lower than the driving currents of other blocks B1, B2, B4 through B9.

In another example embodiment, the block compensation coefficients BSF1 through BSF9 may be inversely proportional to driving voltages of the blocks B1 through B9, respectively. Driving voltage of a first block B1 may be an average of driving voltages of pixels in the first block B1. Driving voltage of a second block B2 may be an average of driving voltages of pixels in the second block B2. Driving voltage of a third block B3 may be an average of driving voltages of pixels in the third block B3. The driving voltages of the remaining blocks B4 through B9 may be determined in a similar manner.

FIG. 4 may be understood as a case where the third block compensation coefficient BSF3 is larger than other block compensation coefficients BSF1, BSF2, BSF4 through BSF9 because the driving voltage of the third block B3 is lower than the driving voltages of other blocks B1, B2, B4 through B9.

In another example embodiment, the block compensation coefficients BSF1 through BSF9 may be proportional to degradation of pixels in the blocks B1 through B9. FIG. 4 may be understood as a case that the third block compensation coefficient BSF3 is larger than other block compensation coefficients BSF1, BSF2, BSF4 through BSF9 because the third block B3 is more degraded than other blocks B1, B2, B4 through B9.

Figure 5:
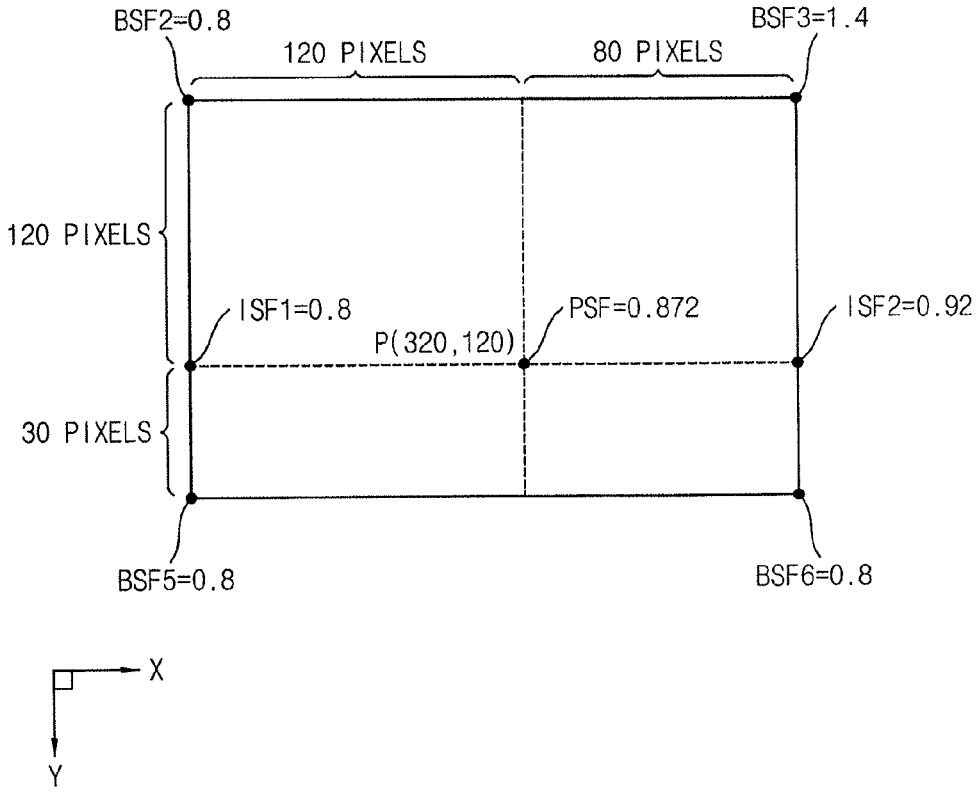
FIG. 5 illustrates an embodiment of a pixel compensation coefficient generator.

FIG. 5 illustrates an example of an operation of the pixel compensation coefficient generator 140 in the data compensator of FIG. 1. Referring to FIG. 5, the pixel compensation coefficient generator 140 generates the pixel compensation coefficient PSF corresponding to the second pixel data RGB2 when the second pixel data RGB2 corresponds to a pixel P which have X-axis coordinate 320 and Y-axis coordinate 200 included in the second block B2.

The block compensation coefficient storage 120 may output a second block compensation coefficient BSF2 of the second block B2 including the pixel P, a third block compensation coefficient BSF3 of a third block B3, a fifth block compensation coefficient BSF5 of the fifth block B5, and a sixth block compensation coefficient BSF6 of the sixth block B6 as the selected some block compensation coefficients SBSF. The third block B3 may neighbor to the second block B2 through a right side of the second block B2. The fifth block B5 may neighbor to the second block B2 through a lower side of the second block B2. The sixth block B6 may neighbor to the third block B3 through a lower side of the third block B3, and the sixth block B6 may neighbor to the fifth block B5 through a right side of the fifth block B5.

The pixel compensation coefficient generator 140 may receive the second, third, fifth, and sixth block compensation coefficients BSF2, BSF3, BSF5, and BSF6 as the selected come block compensation coefficients SBSF.

FIG. 5 shows a case that the pixel compensation coefficient generator 140 generates the pixel compensation coefficient PSF by X-axis interpolation after Y-axis interpolation. The pixel compensation coefficient generator 140 may generate the pixel compensation coefficient PSF by Y-axis interpolation after X-axis interpolation.

The pixel compensation coefficient generator 140 may calculate 0.8 (=0.8*30/150+0.8*120/150) as the first interpolated compensation coefficient ISF1 by interlotting the second block compensation coefficient BSF2 and the fifth block compensation coefficient BSF5. The pixel compensation coefficient generator 140 may calculate 0.92 (=1.4*30/150+0.8*120/150) as the second interpolated compensation coefficient ISF2 by interlotting the third block compensation coefficient BSF3 and the sixth block compensation coefficient BSF6. The pixel compensation coefficient generator 140 may calculate 0.872 (=0.8*80/200+0.92*120/200) as the pixel compensation coefficient PSF by interlotting the first interpolated compensation coefficient ISF1 and the second interpolated compensation coefficient ISF2.

Figure 6:
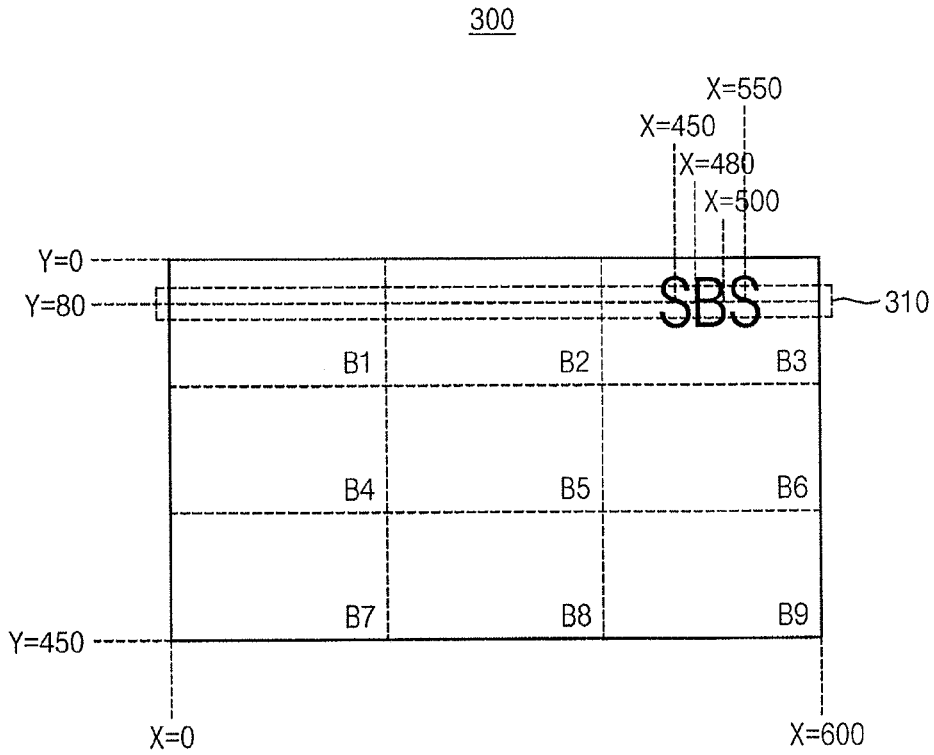
FIG. 6 illustrates an example of the location of degraded pixels.

FIG. 6 illustrates an example of a location of degraded pixels among the first row pixels in the first frame. Referring to FIG. 6, the case is discussed were the first frame 300 includes 600 pixels in X-axis and the first frame 300 includes 450 pixels in Y-axis. The first row pixels 310, which is a set of pixels having 80 as Y-axis value, includes a first degraded pixel, second degraded pixels, and a third degraded pixel. The first degraded pixel is located on a point of (450, 80). The second degraded pixels are located between a point of (480, 80) and a point of (500, 80). The third degraded pixel is located on a point of (550, 80).

Figure 7:
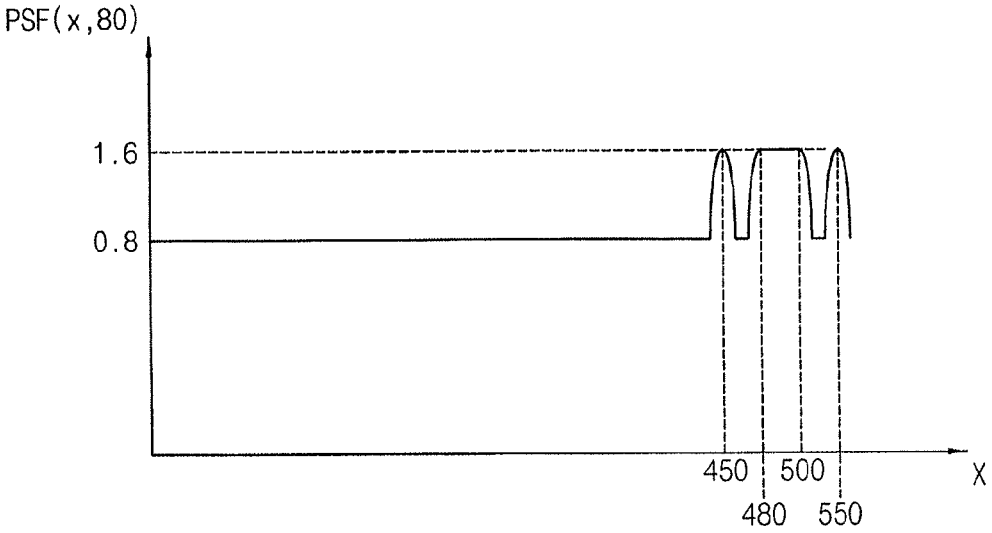
FIG. 7 illustrates an example of pixel compensation coefficients of a first pixel row.

FIG. 7 illustrates an example of pixel compensation coefficients of the first row pixels of FIG. 6. Referring to FIG. 7, pixel compensation coefficient (PSF(450, 80) of the first degraded pixel, pixel compensation coefficients (PSF(480, 80)~PSF(500, 80)) of the second degraded pixels, and pixel compensation coefficient (PSF(550, 80)) have 1.6 which is relatively greater than 0.8 which is the pixel compensation coefficient of the other pixel.

Figure 8:
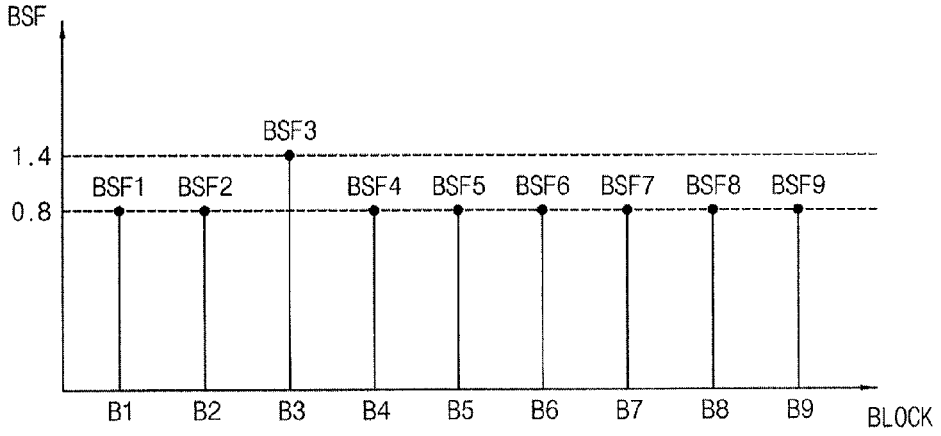
FIG. 8 illustrates another example of compensation coefficients for the blocks.

FIG. 8 illustrates an example of block compensation coefficients of blocks in the first frame of FIG. 6. Referring to FIG. 8, the third block compensation coefficient BSF3 of the third block B3 has 1.4 because of the existence of the first degraded pixel, the second degraded pixels, and the third degraded pixel. Remaining block compensation coefficients BSF1, BSF2, BSF4 through BSF9, other than the third block compensation coefficient BSF3, have 0.8 because the remaining blocks B1, B2, B4 through B9 other than the third block B3 are not degraded.

Figure 9:
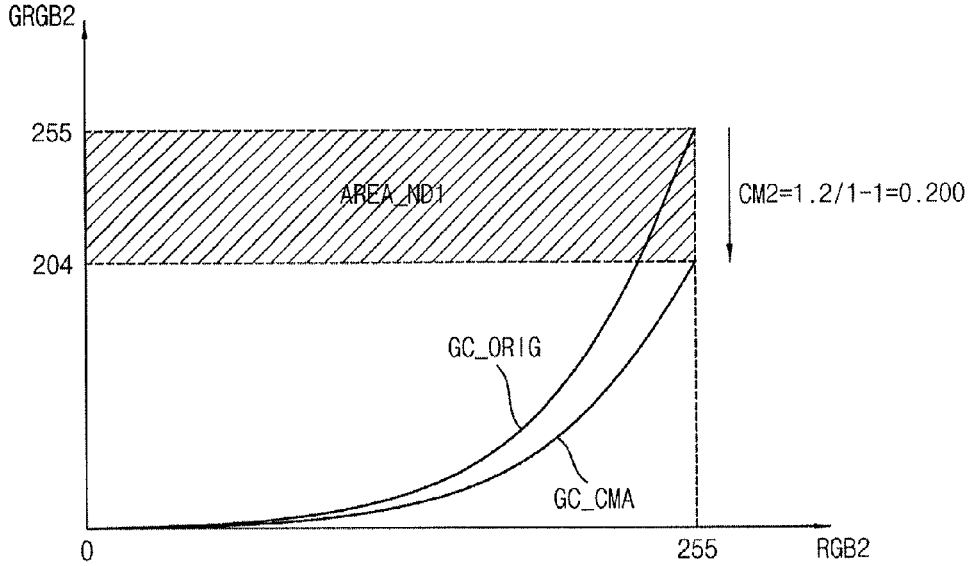
FIG. 9 illustrates a comparative example of a compensation margin calculation.

FIG. 9 illustrates an example of a compensation margin calculation according to a comparative example. Referring to FIG. 9, in the comparative example, the second frame compensation margin CM2 is calculated as 0.200 (=1.2/1−1) by only using the third block compensation coefficient BSF3, which has the maximum value among the block compensation coefficients BSF1 through BSF9.

The gamma applier 150 generates the second gamma applied pixel data GRGB2 by applying a compensation margin applied gamma curve GC_CMA to the second pixel data RGB2. The compensation margin applied gamma curve GC_CMA is generated by scaling the base gamma curve GC_ORIG along the Y-axis based on 0.2, the second frame compensation margin CM2. In this case, the first undisplayable gradation area AREA_ND1 exists from 204 to 255 of the second gamma applied pixel data GRGB2. In the comparative example, the first undisplayable gradation area AREA_ND1 is relatively huge.

Figures 10, 11:
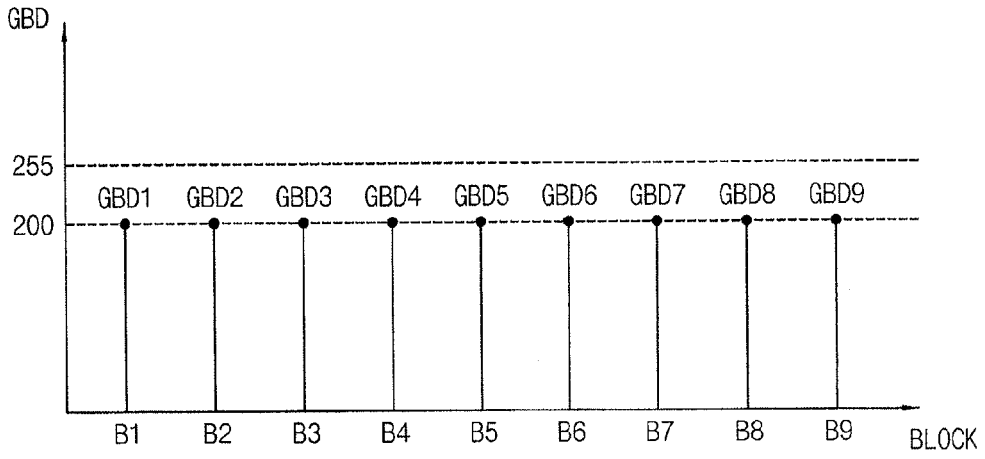
FIGS. 10 and 11 illustrate examples of gamma applied block data.

FIGS. 10 and 11 illustrate an example of gamma applied block data of the compensation margin generator of FIG. 2. Referring to FIGS. 10 and 11, the case is illustrated where the gamma applied block data generator 134 generates 200 as the first gamma applied block data GBD1 through the ninth gamma applied block data GBD9 when all pixel data in the first frame 200 is the same each other.

Figures 12, 13:
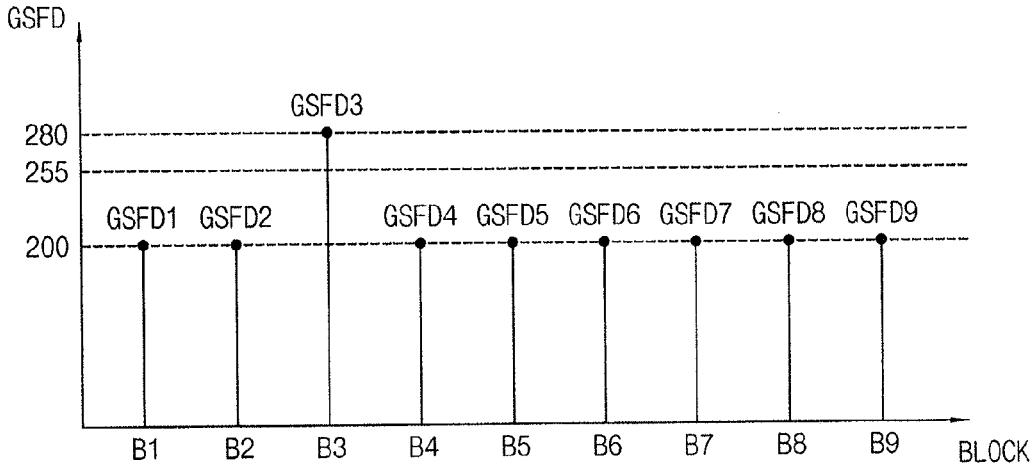
FIGS. 12 and 13 illustrate examples of compensated gamma applied block data.

FIGS. 12 and 13 illustrating examples of compensated gamma applied block data of the compensation margin generator of FIG. 2. Referring to FIGS. 12 and 13, the second multiplier 131 generates the first through ninth compensated gamma applied block data GSFD1 through GSFD9 by multiplying the first through ninth block compensation coefficients BSF1 through BSF9 of FIG. 4 and the first through ninth gamma applied block data GBD1 through GBD9 of FIG. 10, respectively. The third compensated gamma applied block data GSFD3 has 280, and remaining compensated gamma applied block data GSFD1, GSFD2, GSFD4 through GSFD9 have 160. Because the third block B3 is degraded, the third compensated gamma applied block data GSFD3 corresponding to the third block B3 is greater than other compensated gamma applied block data GSFD1, GSFD2, GSFD4 through GSFD9.

Figure 14:
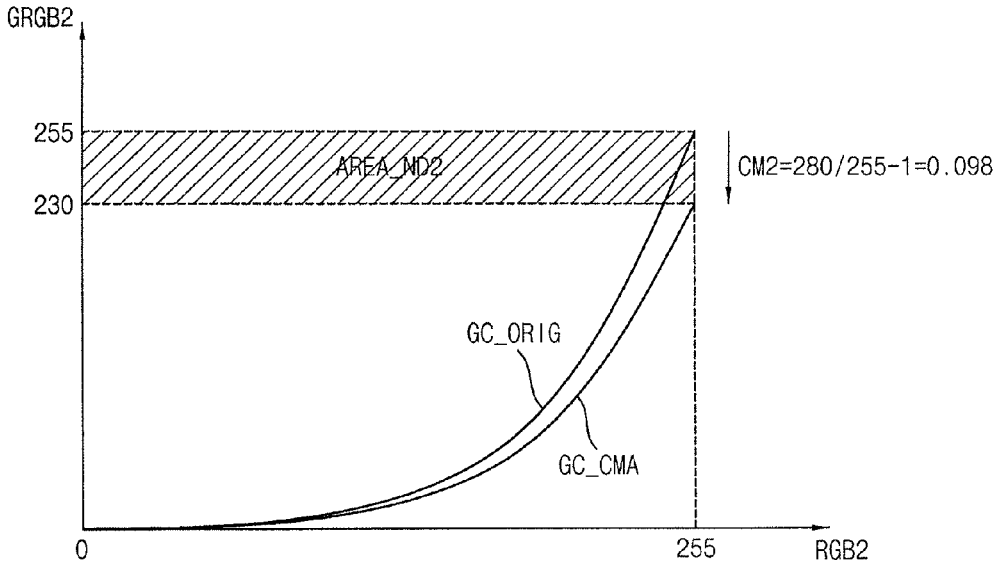
FIG. 14 illustrates an embodiment of a compensation margin calculation.

FIG. 14 illustrates an embodiment of a compensation margin calculation. Referring to FIG. 14, the maximum compensated gamma applied block data generator 132 may output 280, which is the third compensated gamma applied block data GSFD3, as the maximum compensated gamma applied block data MD. If the limit value of the first through ninth gamma applied block data GBD1 through GBD9 is 255, the compensation margin calculator 133 may calculate 0.098 (=(280/255)−1) as the second frame compensation margin CM2

The gamma applier 150 generates the second gamma applied pixel data GRGB2 by applying a compensation margin applied gamma curve GC_CMA to the second pixel data RGB2. The compensation margin applied gamma curve GC_CMA is generated by scaling the base gamma curve GC_ORIG along the Y-axis based on 0.098, the second frame compensation margin CM2. In this case, the second undisplayable gradation area AREA_ND2 exists from 230 to 255 of the second gamma applied pixel data GRGB2. The second undisplayable gradation area AREA_ND2 is relatively smaller than the first undisplayable gradation area AREA_ND1 of FIG. 9 according to the comparative example.

Figure 15:
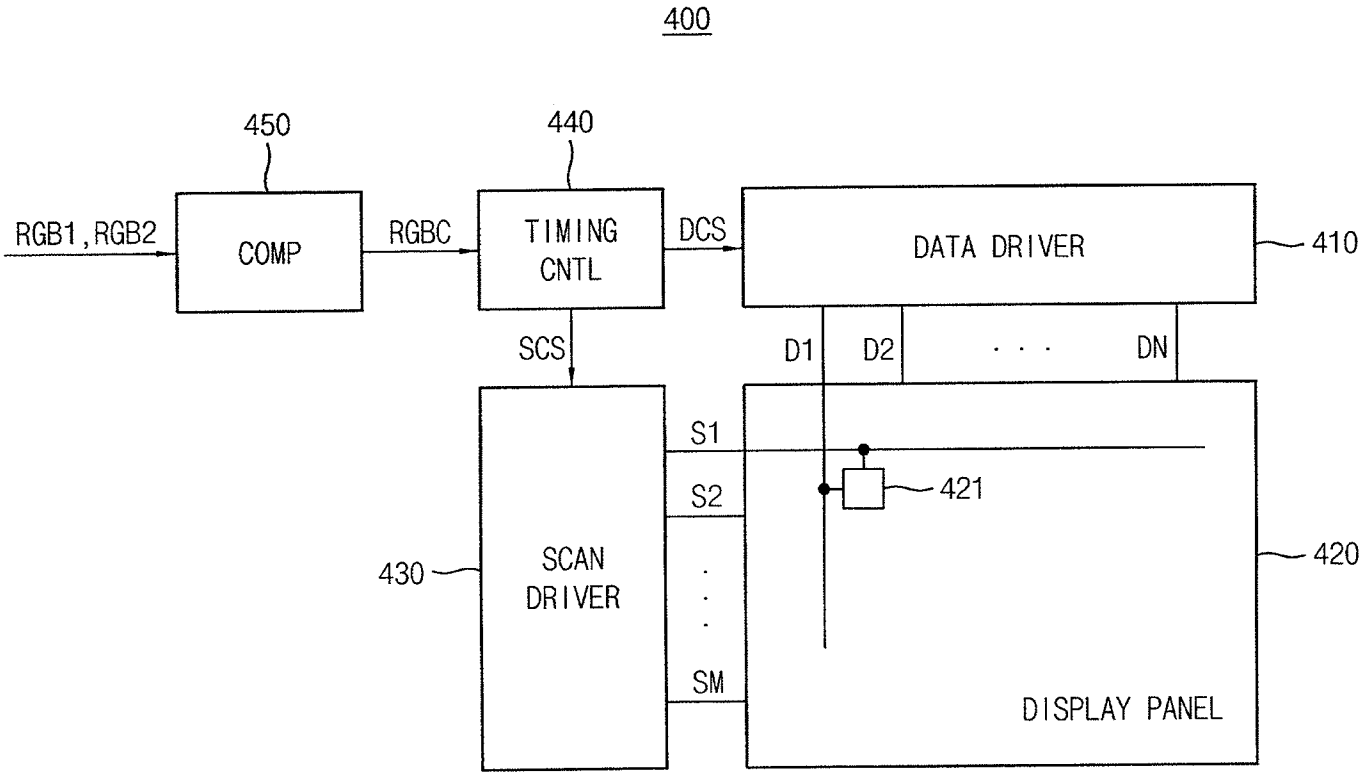
FIG. 15 illustrates an embodiment of a display device.

FIG. 15 illustrates an embodiment of a display device 400 including a data compensator according to any of the aforementioned embodiments. Referring to FIG. 15, a display device 400 includes a data compensator COMP 450, a timing controller TIMING CNTRL 440, a display panel DISPLAY PANEL 420, a data driver DATA DRIVER 410, and a scan driver SCAN DRIVER 430.

The data compensator 450 includes a block compensation coefficient generator, a gamma applier, a compensation margin generator, a block compensation coefficient storage, a pixel compensation coefficient generator, and a first multiplier. The block compensation coefficient generator calculates block compensation coefficients corresponding to blocks in a first frame based on first pixel data RGB1 of the first frame. The gamma applier generates first gamma applied pixel data by applying a first gamma curve corresponding to a first frame compensation margin to the first pixel data RGB1 of the first frame. The gamma applier generates second gamma applied pixel data by applying a second gamma curve corresponding to a second frame compensation margin to a second pixel data RGB2 of a second frame, which is next frame of the first frame.

The compensation margin generator generates the second frame compensation margin based on the block compensation coefficients and the first gamma applied pixel data. The block compensation coefficient storage stores the block compensation coefficients, selects some block compensation coefficients among the block compensation coefficients based on a pixel coordinate, and outputs the selected some block compensation coefficients. The pixel compensation coefficient generator generates a pixel compensation coefficient corresponding to the second pixel data by interpolating the selected some block compensation coefficients based on the pixel coordinate. The first multiplier generates the output pixel data RGBC by multiplying the second gamma applied pixel data and the pixel compensation coefficient.

The data compensator 450 may have the same or similar structure with the data compensator 100 of FIG. 1. The data compensator 450 may be understood based on the references to FIGS. 1 through 14.

The timing controller 440 generates a data driver control signal DCS and a scan driver control signal SCS based on the output pixel data RGBC. The display panel 420 includes a plurality of pixels 421. The data driver 410 generates a plurality of data signals based the data driver control signal DCS and provides the data signals to the pixels 421 through a plurality of data signal lines D1, D2 through DN. The scan driver 430 generates a plurality of scan signals based on the scan driver control signal SCS. The scan driver 430 provides the scan signals to the pixels 421 through a plurality of scan signal lines S1, S2 through SM.

Figure 16:
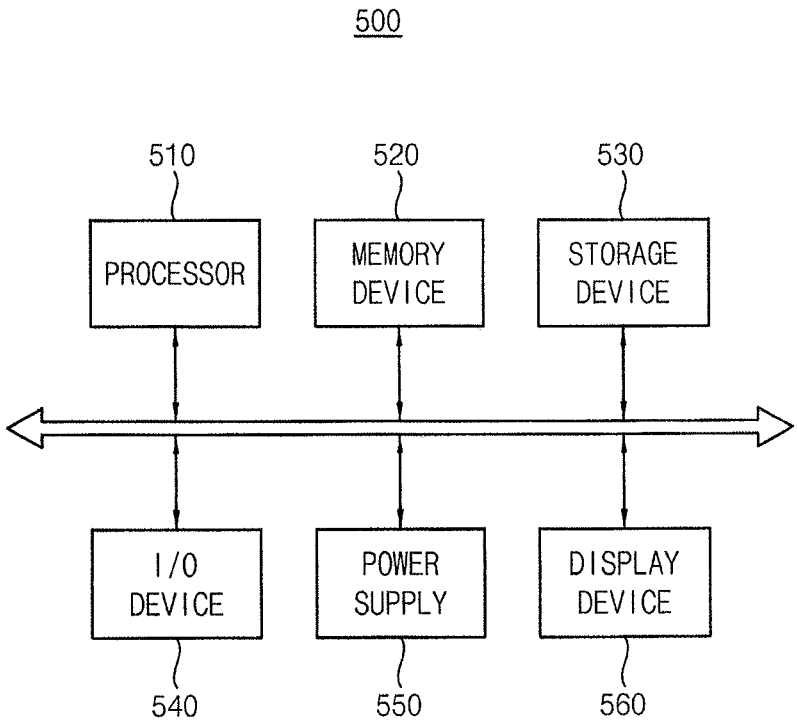
FIG. 16 illustrates an embodiment of an electronic device.

FIG. 16 illustrates an embodiment of an electronic device 500 which includes a display device according to any of the aforementioned embodiments. Referring to FIG. 16, the electronic device 500 includes a processor 510, a memory device 520, a storage device 530, an input/output (I/O) device 540, a power supply 550, and a display device 560. The electronic device 500 may further include a plurality of ports for communicating a video card, a sound card, a memory card, a universal serial bus (USB) device, other electronic devices, etc. Although the electronic device 500 is implemented as a smart-phone, a kind of the electronic device 500 is not limited thereto.

The processor 510 may perform various computing functions. The processor 510 may be a micro processor, a central processing unit (CPU), etc. The processor 510 may be coupled to other components via an address bus, a control bus, a data bus, etc. Further, the processor 510 may be coupled to an extended bus such as a peripheral component interconnection (PCI) bus.

The memory device 520 may store data for operations of the electronic device 500. For example, the memory device 520 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc.

The storage device 530 may be a solid state drive (SSD) device, a hard disk drive (HDD) device, a CD-ROM device, etc. The I/O device 540 may be an input device such as a keyboard, a keypad, a touchpad, a touch-screen, a mouse, etc, and an output device such as a printer, a speaker, etc. The power supply 550 may provide a power for operations of the electronic device 500. The display device 560 may communicate with other components via the buses or other communication links.

The display device 560 may be the display device 400 of FIG. 15. The display device 560 may be understood based on the references to FIGS. 1 through 15.

The example embodiments may be applied to any electronic system 500 having the display device 560. For example, the present embodiments may be applied to the electronic system 500, such as a digital or 3D television, a computer monitor, a home appliance, a laptop, a digital camera, a cellular phone, a smart phone, a personal digital assistant (PDA), a portable multimedia player (PMP), a MP3 player, a portable game console, a navigation system, a video phone, etc.

The present invention may be applied to an OLED display device and an electronic device including the same. For example, the invention may be applied to a monitor, a television, a computer, a laptop computer, a digital camera, a mobile phone, a smartphone, a smart pad, a PDA, a PMP, a MP3 player, a navigation system, and camcorder.

The compensation coefficient generators, gamma appliers, compensation margin generators, pixel compensation coefficient generator, multipliers, and/or other generators or processing features of the embodiments disclosed herein may be implemented in logic which, for example, may include hardware, software, or both. When implemented at least partially in hardware, the compensation coefficient generators, gamma appliers, compensation margin generators, pixel compensation coefficient generator, multipliers, and/or other generators or processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the compensation coefficient generators, gamma appliers, compensation margin generators, pixel compensation coefficient generator, multipliers, and/or other generators or processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. A data compensator, comprising:

a block compensation coefficient generator to calculate block compensation coefficients corresponding to blocks in a first frame based on first pixel data of the first frame;

a gamma applier to generate first gamma applied pixel data by applying a first gamma curve corresponding to a first frame compensation margin to the first pixel data of the first frame, the gamma applier to generate second gamma applied pixel data by applying a second gamma curve corresponding to a second frame compensation margin to a second pixel data of a second frame, which is a next frame of the first frame;

a compensation margin generator to generate the second frame compensation margin based on the block compensation coefficients and the first gamma applied pixel data;

a block compensation coefficient storage to store the block compensation coefficients, to select a number of block compensation coefficients among the block compensation coefficients based on a pixel coordinate, to output the selected block compensation coefficients;

a pixel compensation coefficient generator to generate a pixel compensation coefficient corresponding to the second pixel data by interpolating the selected block compensation coefficients based on the pixel coordinate; and a first multiplier to generate output pixel data by multiplying the second gamma applied pixel data and the pixel compensation coefficient.

2. The data compensator as claimed in claim 1, wherein the compensation margin generator includes:

a gamma applied block data generator to generate gamma applied block data corresponding to the blocks in the first frame based on the first gamma applied pixel data;

a second multiplier to generate compensated gamma applied block data by multiplying the block compensation coefficients and the gamma applied block data, respectively;

a maximum compensated gamma applied block data generator configured to output a largest value among the compensated gamma applied block data as a maximum compensated gamma applied block data; and a compensation margin calculator to calculate the second frame compensation margin based on the maximum compensated gamma applied block data.

3. The data compensator as claimed in claim 2, wherein the compensation margin calculator is to determine the second frame compensation margin based on a ratio of the maximum compensated gamma applied block data to a limit value of the gamma applied block data.

4. The data compensator as claimed in claim 1, wherein:

a first axis of the first gamma curve corresponds to each of the first pixel data and a second axis of the first gamma curve corresponds to each of the first gamma applied pixel data, and the first gamma curve is generated by scaling a base gamma curve along the second axis based on the first frame compensation margin.

5. The data compensator as claimed in claim 1, wherein:

a first axis of the second gamma curve corresponds to the second pixel data and a second axis of the second gamma curve corresponds to the second gamma applied pixel data, and the second gamma curve is to be generated by scaling a base gamma curve along the second axis based on the second frame compensation margin.

6. The data compensator as claimed in claim 1, wherein:

the block compensation coefficient storage is to output a first block compensation coefficient of a first block, a second block compensation coefficient of a second block, a third block compensation coefficient of a third block, and a fourth block compensation coefficient of a fourth block as the selected block compensation coefficients, the second block is adjacent to the first block at a right side of the first block, the third block is adjacent to the first block at a lower side of the first block, the fourth block is adjacent to the second block at a lower side of the second block, and the fourth block is adjacent to the third block at a right side of the third block.

7. The data compensator as claimed in claim 1, wherein the pixel coordinate corresponds to the second pixel data.

8. The data compensator as claimed in claim 1, wherein the block compensation coefficients are inversely proportional to driving currents of the blocks, respectively.

9. The data compensator as claimed in claim 8, wherein driving current of a first block is based on an average of driving currents of pixels in the first block.

10. The data compensator as claimed in claim 1, wherein the block compensation coefficients are inversely proportional to driving voltages of the blocks, respectively.

11. The data compensator as claimed in claim 10, wherein driving voltage of a first block is based on an average of driving voltages of pixels in the first block.

12. The data compensator as claimed in claim 1, wherein the block compensation coefficients are proportional to degradation of pixels in the blocks.

13. The data compensator as claimed in claim 1, wherein at least one of the block compensation coefficient generator, gamma applier, compensation margin generator, pixel compensation coefficient generator, and first multiplier is implemented by instructions to be performed by a processor.

14. A display device, comprising:

a data compensator to generate an output pixel data; a timing controller to generate a data driver control signal and a scan driver control signal based on the output pixel data;

a display panel including a plurality of pixels;

a data driver cc generate a plurality of data signals based the data driver control signal, the data driver to provide the data signals to the pixels through a plurality of data signal lines; and a scan driver to generate a plurality or scan signals based on the scan driver control signal, the scan driver to provide the scan signals to the pixels through a plurality of scan signal lines, wherein the data compensator includes:

a block compensation coefficient generator to calculate block compensation coefficients corresponding to blocks in a first frame based on first pixel data of the first frame;

a gamma applier to generate first gamma applied pixel data by applying a first gamma curve corresponding to a first frame compensation margin to the first pixel data of the first frame, the gamma applier to generate second gamma applied pixel data by applying a second gamma curve corresponding to a second frame compensation margin to a second pixel data of a second frame, which is a next frame of the first frame;

a compensation margin generator to generate the second frame compensation margin based on the block compensation coefficients and the first gamma applied pixel data;

a block compensation coefficient storage to store the block compensation coefficients, to select a number of the block compensation coefficients based on a pixel coordinate, to output the selected block compensation coefficients;

a pixel compensation coefficient generator to generate a pixel compensation coefficient corresponding to the second pixel data by interpolating the selected block compensation coefficients based on the pixel coordinate; and a first multiplier to generate the output pixel data by multiplying the second gamma applied pixel data and the pixel compensation coefficient.

15. The display device as claimed in claim 14, wherein the compensation margin generator includes:

a gamma applied block data generator to generate gamma applied block data corresponding to the blocks in the first frame based on the first gamma applied pixel data;

a second multiplier to generate compensated gamma applied block data by multiplying the block compensation coefficients and the gamma applied block data, respectively;

a maximum compensated gamma applied block data generator to output the biggest value among the compensated gamma applied block data as a maximum compensated gamma applied block data; and a compensation margin calculator to calculate the second frame compensation margin based on the maximum compensated gamma applied block data.

16. The display device as claimed in claim 15, wherein the compensation margin calculator is to determine the second frame compensation margin based on a ratio of the maximum compensated gamma applied block data to a limit value of the gamma applied block data.

17. A data compensator, comprising:

first logic circuit to calculate block compensation coefficients for blocks in a first frame based on first pixel data of the first frame;

second logic circuit to generate first gamma applied pixel data based on the first pixel data of the first frame and to generate second gamma applied pixel data based on the first gamma applied pixel data and second pixel data of a second frame adjacent the first frame;

third logic circuit to select a number of the block compensation coefficients based on a pixel coordinate;

fourth logic circuit to generate a pixel compensation coefficient corresponding to the second pixel data by interpolating the selected block compensation coefficients based on the pixel coordinate; and fifth logic circuit to generate output pixel data based on the second gamma applied pixel data and the pixel compensation coefficient.

18. The compensator as claimed in claim 17, wherein the second logic circuit is to:

generate the first gamma applied pixel data by applying a first gamma curve corresponding to a first frame compensation margin to the first pixel data of the first frame, and generate the second gamma applied pixel data by applying a second gamma curve corresponding to a second frame compensation margin to the second pixel data of the second frame.

19. The compensator as claimed in claim 18, further comprising:

sixth logic circuit to generate the second frame compensation margin based on the block compensation coefficients and the first gamma applied pixel data.

20. The compensator as claimed in claim 17, wherein at least one of the first through fifth logic circuit is implemented by instructions for controlling a computer.

* * * * *